US011268749B2

(12) United States Patent
Weiss et al.

(10) Patent No.: US 11,268,749 B2
(45) Date of Patent: Mar. 8, 2022

(54) HOUSEHOLD REFRIGERATION APPLIANCE

(71) Applicant: BSH HAUSGERAETE GMBH, Munich (DE)

(72) Inventors: Claudia Weiss, Illerkirchberg (DE); Thomas Schaefer, Giengen (DE); Frank Cifrodelli, Ulm (DE); Julio Cesar Schmidt, Knoxville, TN (US)

(73) Assignee: BSH Hausgeraete GmbH, Munich (DE)

( * ) Notice: Subject to any disclaimer, the term of this patent is extended or adjusted under 35 U.S.C. 154(b) by 154 days.

(21) Appl. No.: 16/677,773

(22) Filed: Nov. 8, 2019

(65) Prior Publication Data

US 2020/0149799 A1 May 14, 2020

(30) Foreign Application Priority Data

Nov. 8, 2018 (DE) ..... 102018219009.7

(51) Int. Cl.
*F25D 17/06* (2006.01)

(52) U.S. Cl.
CPC ..... *F25D 17/065* (2013.01)

(58) Field of Classification Search
CPC ..... F25D 17/08
See application file for complete search history.

(56) References Cited

U.S. PATENT DOCUMENTS 3,020,733 A * 2/1962 Hubacker ..... F25D 17/065 62/414
5,921,104 A * 7/1999 Chang ..... F24F 9/00 62/407
6,122,879 A * 9/2000 Montes ..... F25D 23/065 52/592.1
6,351,967 B1 3/2002 Adachi et al.
2013/0000333 A1 1/2013 Kim et al.
(Continued)

FOREIGN PATENT DOCUMENTS

CN 202835984 U 3/2013
JP 2001059672 A 3/2001
(Continued)

OTHER PUBLICATIONS

Translation of Cho (Year: 2003).*

*Primary Examiner* — Emmanuel E Duke
(74) *Attorney, Agent, or Firm* — Laurence A. Greenberg; Werner H. Stemer; Ralph E. Locher

(57) ABSTRACT

A household refrigeration appliance has a housing and an inner compartment configured in the housing with a cover, which extends along a rear wall of the inner compartment and divides the inner compartment into a storage compartment for chilled goods and a cold air distribution region with a cold air distribution system arranged therein and with a first visible surface formed by the cover and facing an access opening of the inner compartment. The cold air distribution system has a vertical cold air duct segment extending in the direction of a top wall, which is arranged parallel to the rear wall in the longitudinal direction and has a horizontal cold air duct segment branching from the vertical cold air duct segment and extending in the direction of a left or right side wall, which is arranged parallel to the rear wall in the longitudinal direction.

17 Claims, 6 Drawing Sheets

(56) References Cited

U.S. PATENT DOCUMENTS

| | | | | |
|---|---|---|---|---|
| 2015/0033773 | A1 | 2/2015 | Tajima et al. | |
| 2016/0370105 | A1* | 12/2016 | Park | F25D 25/025 |
| 2017/0261250 | A1* | 9/2017 | Cho | F25D 17/062 |

FOREIGN PATENT DOCUMENTS

| | | | | |
|---|---|---|---|---|
| JP | 3603942 | B2 | | 12/2004 |
| JP | 2012220116 | A | | 11/2012 |
| KR | 20030065943 | A | * | 8/2003 |

* cited by examiner

HOUSEHOLD REFRIGERATION APPLIANCE

CROSS-REFERENCE TO RELATED APPLICATION

This application claims the priority, under 35 U.S.C. § 119, of German application DE 10 2018 219 009.7, filed Nov. 8, 2018; the prior application is herewith incorporated by reference in its entirety.

BACKGROUND OF THE INVENTION

Field of the Invention

The invention relates to a household refrigeration appliance with a housing and an inner compartment configured therein with a cover, which extends along a rear wall of the inner compartment and divides the inner compartment into a storage compartment for chilled goods and a cold air distribution region with a cold air distribution system arranged therein.

U.S. Pat. No. 6,351,967 B1 discloses an air distribution system for a household refrigeration appliance, which feeds cold air from the freezer region into the refrigeration region by way of various air outlets. In this process the air is blown out by way of various air outlets at different levels in both a vertical and horizontal direction. The air outlets are supplied with cold air by a plurality of vertical cold air ducts, which are concealed behind a cover and are not visible from the storage compartment. A cold air distribution system with a plurality of vertical cold air ducts on the refrigeration compartment rear wall is complex and expensive.

In order to make other components of the household refrigeration appliance more readily accessible for maintenance, other components of the household refrigeration appliance can also be arranged on a refrigeration compartment rear wall behind a cover, in addition to a cold air distribution system. As the plurality of vertical cold air ducts increases the risk of frost damage to the other components, there is a need to improve the cold air distribution system compared with the prior art.

SUMMARY OF THE INVENTION

It is the object of the present invention to equip a household refrigeration appliance with an improved cold air distribution system compared with the prior art.

The object is achieved by the features of the independent claim. Further embodiments are set out in the subclaims.

An inventive household refrigeration appliance contains a housing and an inner compartment configured in the housing with a cover, which extends along a rear wall of the inner compartment and divides the inner compartment into a storage compartment for chilled goods and a cold air distribution region with a cold air distribution system arranged therein and with a first visible surface formed by the cover and facing an access opening to the inner compartment. The cold air distribution system has a vertical cold air duct segment extending in the direction of a top wall, which is arranged essentially parallel to a rear wall in the longitudinal direction, and has a horizontal cold air duct segment branching from the vertical cold air duct segment and extending in the direction of a left or right side wall, which is arranged essentially parallel to a rear wall in the longitudinal direction. The horizontal cold air duct segment and the vertical cold air duct segment are arranged with an offset in the depthwise direction of the inner compartment and at least part of a longitudinal extension of the vertical cold air duct segment being arranged behind the first visible surface and at least part of a longitudinal extension of the horizontal cold air duct segment being arranged in front of the first visible surface.

This has the advantage that horizontal air supply ducts branch from only one vertical main air duct and conduct the cold air to a plurality of air outlets in the widthwise direction of the inner compartment or in the horizontal direction of the household refrigeration appliance. This allows more regular cold air distribution and more regular temperature distribution in both the vertical and horizontal directions of the storage compartment, supplied by a single vertical main air duct.

Also the arrangement of the vertical and horizontal cold air ducts with an offset in the depthwise direction of the inner compartment allows adequate space for the arrangement of other components, in particular conduits to and from the other components, of the household refrigeration appliance, without losing too much storage space or increasing the risk of frost damage. Conduits to or from refrigeration, electrical or water-conducting components or parts can therefore be positioned securely between the horizontal cold air duct segment and the rear wall of the inner compartment. The components or parts can then be accessed from the storage compartment for maintenance work simply by removing the cover.

It is a further advantage that improved air distribution and therefore more regular temperature distribution can be achieved in a storage compartment for chilled goods. A greater number of air outlets in the storage compartment allows more regular distribution of the cold air in both the heightwise direction or vertical direction of the storage compartment and in the widthwise direction or horizontal direction of the storage compartment. It is particularly advantageous that the inventive air guidance geometry is integrated in the existing cold air distribution system. This means there is no need for expensive additional parts and reduces assembly time and assembly costs. The positioning of the cold air ducts or air guidance elements on the rear face of the cover has the advantage that technical components of the household refrigeration appliance are concealed or cannot be seen from the storage compartment. The arrangement of the horizontal and vertical cold air duct segments with an offset in the depthwise direction of the inner compartment also means that interruptions or other parts concealed at the rear can be easily circumvented.

A household refrigeration appliance means in particular that food can be preserved for longer periods by cooling therein.

A "visible surface" generally refers to a surface of the cover, which faces the access opening to the inner compartment and is visible to the user when said user looks into the storage compartment. The first visible surface is preferably a surface of a cover segment facing the access opening. Even if a planar cover surface is desirable for design reasons, the cover generally has projections or projecting surfaces. Therefore the first visible surface or the first cover segment should be formed by the visible surface of the cover, which represents a large part or the greatest part or the main part of the surface of the cover. The second visible surface should be formed by the visible surface of the cover, which represents a smaller surface area than the first visible surface.

"C ove r" refers in particular to an intermediate wall or cold air duct cover. The cover preferably covers the rear wall of the inner compartment completely. As a result other parts and components of the household refrigeration appliance are concealed behind the cover in addition to the cold air distribution system.

A "vertical cold air duct segment" refers in particular to a cold air duct segment, which is aligned in the direction of the top wall of the inner compartment. An air flow therefore forms in the vertical cold air duct segment, which runs parallel to the rear wall and flows in the direction of the top wall of the inner compartment.

A "horizontal cold air duct segment" refers in particular to a cold air duct segment, the longitudinal extension of which is aligned in the direction of a left or right side wall. An air flow therefore forms in the horizontal cold air duct segment, which runs parallel to the rear wall of the inner compartment and flows in the direction of a left or right side wall of the inner compartment. It is therefore possible for the air flow to flow in the direction of one of the two side walls or the left and right side wall of the inner compartment. It is however also possible for a plurality of horizontal cold air duct segments to be arranged in the inner compartment, with a first horizontal cold air duct segment forming an air flow in the direction of the left side wall of the inner compartment and a second horizontal cold air duct segment forming an air flow in the direction of the right side wall of the inner compartment. The first and second horizontal cold air duct segments here both branch from the vertical cold air duct segment.

"Longitudinal direction" refers specifically to the direction of the longest extension of something. Within the meaning of the invention, the direction of the longest extension of the vertical cold air duct segment and horizontal cold air duct segment.

According to a further embodiment of the invention the longitudinal extension of the vertical cold air duct segment can be arranged completely behind the first visible surface and the longitudinal extension of the horizontal cold air duct segment can be arranged completely in front of the first visible surface. This has the advantage that there is adequate space for the arrangement of other components of the household refrigeration appliance between the horizontal cold air duct segment and the rear wall of the inner compartment, without losing too much storage space or increasing the risk of frost damage. It is therefore possible to reduce or completely prevent frost damage in particular in water-conducting components by simply changing the structure of the cold air distribution system.

According to one embodiment of the invention the majority of the longitudinal extension of the horizontal cold air duct segment can adjoin the top wall and open into a non-central air outlet to the storage compartment. This means on the one hand that the horizontal cold air duct segment and a correspondingly projecting region on the cover are out of direct view for the customer and on the other hand that the horizontal cold air conducting segment is arranged in a region of the inner compartment, which is of little use for the storage of chilled goods due to poor accessibility for the user. The central air outlet preferably also adjoins the top wall or is at least arranged in proximity to the top wall. The non-central air outlet is preferably arranged closer to a left or right side wall of the inner compartment than to a virtual vertical center plane of the cover. This means there is also homogeneous temperature distribution in the widthwise direction of the storage compartment. The cold air released from the air outlets can also sink downward in proximity to the top wall due to natural convection in the storage compartment and ensure an even temperature distribution or temperature stratification in the storage compartment with simple means. It is therefore also possible for air outlets in proximity to the top wall to be sufficient to allow an even temperature distribution or temperature stratification at least in the widthwise direction of the storage compartment. It also has the advantage that cold air is released into a region of the storage compartment, which cannot be readily used as a storage location due to poor accessibility from the access opening. The cold air flowing out of the air outlets cannot therefore result in excessive cooling or even frost damage to the stored chilled goods.

According to one embodiment of the invention the cover can cover the rear wall essentially completely. In order to achieve a visually high-quality and pleasing appearance and conceal unevenness on the rear wall, it is advantageous for the rear wall to be completely concealed by a high-quality and visually pleasing lining in the form of a cover.

According to a further embodiment of the invention a main air flow in the vertical cold air duct segment can flow essentially perpendicular to a top wall of the inner compartment and a partial air flow in the horizontal cold air duct segment can flow essentially parallel to the top wall of the inner compartment. This has the advantage that the at least one horizontal cold air duct segment is supplied with cold air from one central main air flow. The vertical cold air duct segment can therefore supply a plurality of horizontal cold air duct segments with cold air.

According to one embodiment of the invention a connecting segment can be arranged between the vertical cold air duct segment and the horizontal cold air duct segment, intersecting a first visible surface plane formed by the visible surface and connecting the vertical cold air duct segment and the horizontal cold air duct segment. Because the vertical cold air duct segment and the horizontal cold air duct segment are arranged with an offset in the depthwise direction of the inner compartment, it is necessary for a connecting segment to bridge or compensate for this difference in the depthwise direction. The connecting segment advantageously has an arched contour in cross section, which bridges the depth difference between the cold air ducts. This has the advantage that a transition can be achieved between the cold air duct segments with their offset in the depthwise direction of the inner compartment with simple and economical means and the air flow is deflected in the direction of the access opening of the inner compartment and in the direction of the left or right side wall.

According to one embodiment of the invention a second visible surface can be formed by a second cover segment of the cover and the first visible surface can be formed by a first cover segment of the cover, the second cover segment being arranged closer to the access opening than the first cover segment. This means that the horizontal cold air duct segment, which projects into the storage compartment, is also concealed by the cover. This also has the advantage that although the horizontal cover segment concealed by the second cover segment takes up space in the storage compartment, the offset of the first cover segment in the depthwise direction of the inner compartment can create additional storage space.

According to one embodiment of the invention the second visible surface or the second cover segment can be configured at an angle to the first visible surface or to the first cover segment. The angle of the second cover segment relative to the first cover segment ensures an acceptable transition, so the user notices the transition less and is less aware of the projecting second cover segment. There are also no gaps and obvious edges, which encourage the accumulation of dirt, and the transition is out of the direct view of a user. The angled second visible surface or the angled second cover segment also means that the horizontal cold air duct segment takes up less storage space in the storage compartment. The angled configuration of the second visible surface or the second cover segment relative to the first visible surface or first cover segment also means that the air flow or partial air flow has to be deflected less, thereby reducing the flow resistance in the cold air distribution system.

According to one embodiment of the invention the majority of the horizontal cold air duct segment can be arranged behind the second cover segment and in front of the first cover segment; the horizontal cold air duct segment can preferably be arranged completely behind the second cover segment and in front of the first cover segment. This has the advantage that the horizontal cold air duct segment cannot be seen from the storage compartment or is concealed behind the second cover segment. As a result the storage compartment has an esthetically pleasing appearance, as functional elements on the rear wall, for example the cold air distribution system, water tank, light elements and corresponding conduits to and from these, are covered by a cover or cannot be seen by a user from the storage compartment.

According to one embodiment of the invention the first cover segment or the first visible surface and the second cover segment or the second visible surface are configured as a single piece. This has the advantage that the cold air distribution system, containing the vertical cold air duct segment and the horizontal cold air duct segment, is concealed behind a cover formed from one piece. The single-piece cover does not have gaps or connecting points, so the cover ensures that the customer sees the rear wall of the storage compartment as visually pleasing and high quality and it is less likely that dirt will accumulate. Mounting a single-piece cover on the rear wall of the inner compartment also significantly reduces assembly time and costs, as the functional parts between the rear wall of the inner compartment and the cover can be covered or made accessible by mounting or removing a single part.

According to one embodiment of the invention the longitudinal extension of the horizontal cold air duct segment can be arranged between a first visible surface plane formed by the first visible surface and a visible surface plane formed by the second visible surface. The second visible surface plane is preferably configured at an angle to the first visible surface plane, so that the majority of the horizontal cold air duct segment is arranged between the first visible surface plane and the second visible surface plane. The first visible surface plane and the second visible surface plane are at an angle or form an acute angle, the horizontal cold air duct segment extending in the direction of a left or right side wall of the inner compartment. The acute angle or angle formed between the first visible surface plane and the second visible surface plane faces an access opening of the inner compartment.

According to one embodiment of the invention the second visible surface can directly adjoin a top wall of the inner compartment. Because the second visible surface, which conceals the horizontal cold air duct segment behind it and has at least one central and one non-central air outlet, directly adjoins a top wall of the inner compartment, the cold air in the region of the top wall flows into the upper region of the storage compartment for chilled goods. The cold air can therefore sink downward in the direction of the bottom wall, allowing even and homogeneous temperature distribution in the widthwise direction and heightwise direction of the storage compartment. It is of course also possible for further visible surfaces or further cover segments to project from the surface of the first visible surface or the first cover segment, behind which further horizontal cold air duct segments or other components of the household refrigeration appliance can be arranged or concealed.

According to one embodiment of the invention a central air outlet and the non-central air outlet can be arranged or integrated in the cover, it being possible for a first partial air flow branching from the main air flow to flow out through the central air outlet into the storage compartment and a second partial air flow branching from the main air flow to flow out by way of the horizontal cold air duct segment through the non-central air outlet into the storage compartment. This has the advantage that an air outlet is arranged in a central region of the storage compartment as well as in a non-central region of the vertical cold air duct segment or in proximity to the left or right side wall of the storage compartment. This allows a homogeneous temperature distribution to be achieved in the storage compartment both in the longitudinal extension of the vertical cold air duct segment and in the longitudinal extension of the horizontal cold air duct segment. So that it is not necessary to provide additional air guidance elements extending vertically or in the heightwise direction of the storage compartment or separate vertical air guidance elements, the horizontal cold air duct segment branches from the vertical cold air duct segment to achieve a homogeneous temperature distribution or temperature stratification in the widthwise direction of the storage compartment.

According to one embodiment of the invention the central air outlet and the non-central air outlet can be arranged in the second visible surface or in the second cover segment. As the second visible surface plane is arranged in proximity to the top wall or directly adjoins the top wall, this allows a homogeneous temperature distribution or temperature stratification to be formed in the widthwise direction of the storage compartment. The cold air flowing out of the central air outlet, which is arranged in the center of the storage compartment and can be supplied directly from the vertical cold air duct segment, and the non-central air outlet, which is arranged laterally or in proximity to the left or right side wall of the inner compartment and can be supplied from the horizontal cold air duct segment, is released in proximity to the top wall of the inner compartment, preferably in proximity to a corner region between the top wall and the rear wall of the inner compartment. This allows the cold air from the cold air distribution system to be distributed over the entire width of the storage compartment and the cold air flowing into the storage compartment to sink gradually downward from the top wall of the inner compartment to the bottom wall. This results in even or homogeneous temperature distribution both in the widthwise direction and in the heightwise direction of the storage compartment.

According to one embodiment of the invention a divider can be arranged in the region of the connecting segment, the divider dividing the volume of the main air flow in the vertical cold air duct segment between the central air outlet and the non-central air outlet. This means that the volume of the main air flow in the vertical cold air duct segment can be divided using simple and economical means. This can be done by means of integrated projections or corresponding radii into the heat insulation forming the cold air distribution system. An air flap system can also be provided, dividing the volume of the main air flow in the vertical cold air duct segment between the central air outlet and the non-central air outlet.

According to one embodiment of the invention a first heat insulation segment can be arranged between the cover and the vertical cold air duct segment and a second heat insulation segment can be arranged between the cover and the horizontal cold air duct segment, the first heat insulation segment and the second heat insulation segment being connected to one another with a form fit by a plug-type connection. This means that the heat insulation segment forming the vertical cold air duct segment and the heat insulation segment forming the horizontal cold air duct segment can be achieved with simple and economical means. The first heat insulation segment and the second heat insulation segment can thus be configured by a plug-type connection, a latching connection or generally by contours that can be connected to one another with a form fit. This has the advantage that a vertical cold air duct segment and a horizontal cold air duct segment can be sealed off from the storage compartment with heat insulation using simple and economical means so that the formation of condensation on the first and second visible surfaces facing the storage compartment is reduced as far as possible. The heat insulation layer is generally made of extruded polystyrene but can also be made of other materials, such as for example polyurethane sheets, Aerogel, vacuum insulation sheets, with similar heat insulation properties.

According to one embodiment of the invention the horizontal cold air duct segment can be formed by the cover. This dispenses with the need for expensive additional parts and reduces assembly time and costs. As the horizontal cold air duct segment is simply the last part of the air conductor to the storage compartment, it is sometimes also possible to dispense with heat insulation in the region of the horizontal cold air duct segment.

According to one embodiment of the invention the horizontal cold air duct segment can extend along a corner region between top wall and rear wall. Such corner regions of a storage compartment or inner compartment are not particularly suitable for storing stored goods, as they are not easy for the customer to access from the access opening. Such regions or corner regions of the inner compartment can therefore be used for functional components, such as air-conducting, electrical or water-conducting parts of the household refrigeration appliance, without losing any significant storage space in the storage compartment.

The terms "top", "bottom", "front", "rear", "horizontal", "vertical", "depthwise direction", "widthwise direction", "heightwise direction", etc. refer to the positions and orientations resulting when the appliance is used and arranged in the correct manner and when an observer is standing in particular in front of the appliance and looking in the direction of the appliance.

Further features of the invention will emerge from the claims, figures and description of the figures. The features and feature combinations cited above in the description as well as the features and feature combinations cited in the following in the description of the figures and/or shown in the figures alone can be used not only in the respectively cited combination but also in other combinations, without departing from the scope of the invention. Therefore embodiments of the invention which are not specifically described and illustrated in the figures but will emerge and can be generated from the described embodiments as a result of separate feature combinations are also deemed to be covered and disclosed by the invention. Embodiments and feature combinations which do not therefore have all the features of an originally formulated independent claim should also be deemed to be disclosed. Embodiments and feature combinations, which go beyond or deviate from the feature combinations set out in the claim references, should also be deemed to be disclosed, in particular as a result of the embodiments set out above.

Other features which are considered as characteristic for the invention are set forth in the appended claims.

Although the invention is illustrated and described herein as embodied in a household refrigeration appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
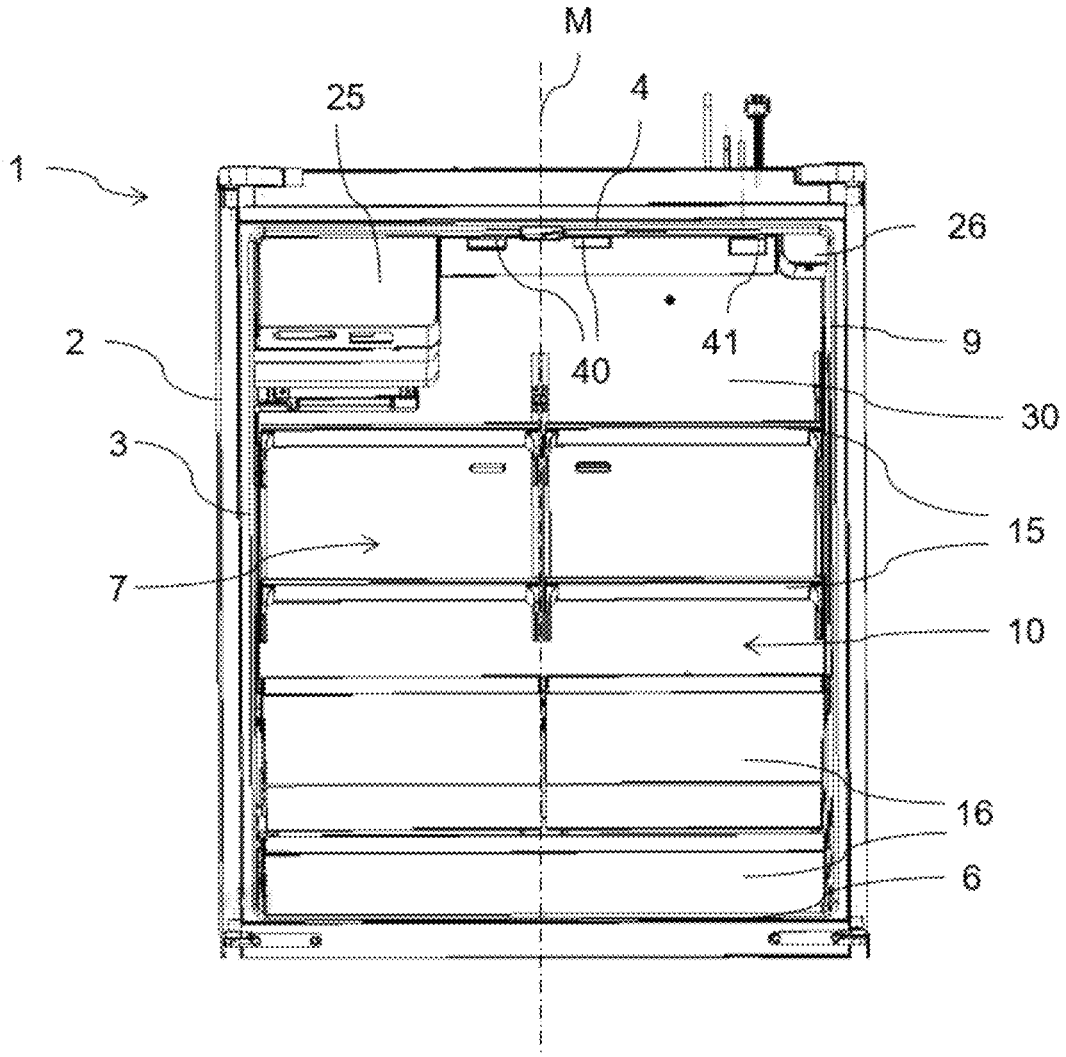
FIG. 1 is a diagrammatic, front view of a household refrigeration appliance according to the invention.

Identical elements or those of identical function are shown with the same reference characters in the figures.

Referring now to the figures of the drawings in detail and first, particularly to FIG. 1 thereof, there is shown a front view of an inventive household refrigeration appliance 1. The household refrigeration appliance 1 is formed by a housing 2, which forms an inner compartment 10. The inner compartment 10 has a cover 30, which separates a cold air distribution system 51 (not shown here) from a storage compartment 11 for stored goods to be chilled. The inner compartment 10 has a left 3 and right side wall 9, a top wall 4, a bottom wall 6 and a rear wall 5 (not shown in detail here). The cover 30 is arranged at a distance from the rear wall 5 and covers it essentially completely. The storage compartment 11 generally serves to cool chilled goods in a frost-free manner, preferably at temperatures between +4 and +8° C. The storage compartment 11 can however also be configured as a zero degrees compartment, in particular for keeping fruit or vegetables fresh, with a storage temperature of around 0°. The storage compartment 11 can however also be configured as a multifunction compartment, with storage temperatures below 0° C. and above 0° C. This allows a temperature range for example from −18° C. to +14° C. to be achieved in the storage compartment 11. The storage compartment 11 can however also be configured to freeze stored goods, preferably at a storage temperature from −18° C. to −14° C.

Shelves 15 for storing stored goods are arranged in the storage compartment 11. The shelves 15 are preferably secured on the rear wall 5 of the inner compartment 10 or on the cover 30 by a corresponding holding apparatus. Drawers 16 are arranged in the lower region of the storage compartment 11 or the bottom region of the storage compartment 11, these being suitable for storing fruit and vegetables or meat and fish.

The illustrated household refrigeration appliance has an air circulation system (not shown in detail here), which feeds cold air from an evaporator arranged in a freezer region by way of various air outlets 40, 41 into the storage compartment 11. The cold air is blown out by way of the various air outlets 40, 41 at the different levels both in a vertical and horizontal direction. It is blown out by what are referred to as cold air distribution systems 51, which have the corresponding air outlets 40, 41 and in some instances integrated control valves. The first air outlets 40 are located in a central region or proximity to the center axis M of the cover 30. The non-central air outlet 41 is located away from the center axis M in proximity to the right side wall 9. The cold air distribution system 51 is concealed behind the cover 30 and cannot be seen from the storage compartment. This gives the storage compartment 11 a pleasing appearance, as functional elements and irregularities for the most part cannot be seen from the storage compartment 11. A fan (not shown in detail here) is generally used to circulate the cold air from an evaporator to the storage compartment 11.

Arranged in the inner compartment 10 are an icebox 25 for producing ice cubes and a water filter 26 for filtering water from a water distribution system. The water filter 26 and the icebox 25 are supplied with water from a water distribution system (not shown in detail here). A corresponding water tank 20 and water conduits 21 are concealed behind the cover 30 here and cannot be seen from the storage compartment 11.

So that the customer can also access chilled goods stored in the storage compartment 11, an access opening 7 is configured, which can be closed with a heat-insulated and pivotably hinged door (not shown in detail here) when the household refrigeration appliance is not in use.

Figure 2:
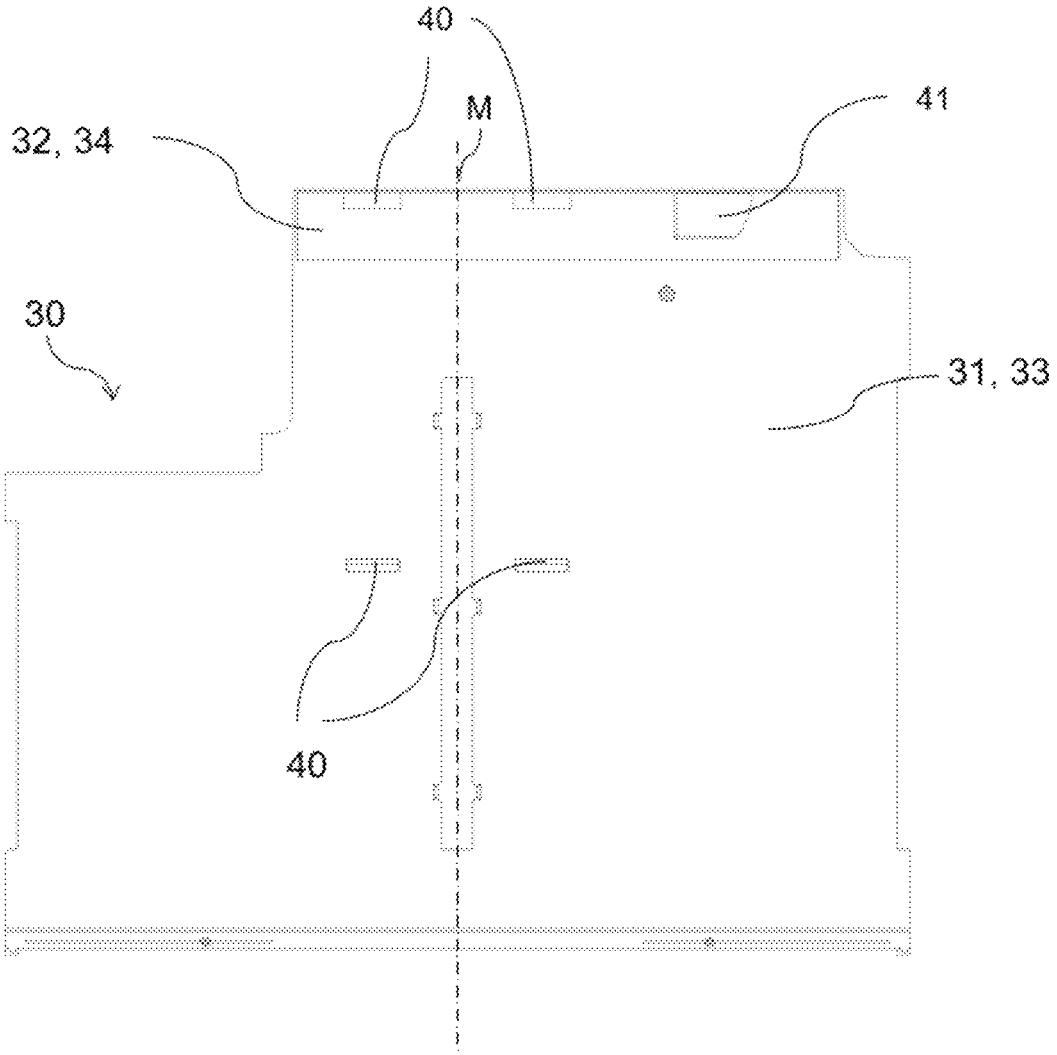
FIG. 2 is a front view of a cover of the inventive household refrigeration appliance.

FIG. 2 shows a front view of the cover 30 of the inventive household refrigeration appliance. The cover 30 has the air outlets 40, which are arranged in a central or middle region or in proximity to a center axis M of the cover 30. The air outlets 40 are provided to allow an adequate cold air supply to different levels in the heightwise direction of the storage compartment 11. This ensures or achieves a homogeneous and regular temperature distribution or temperature stratification in the heightwise direction of the storage compartment 11. The cover 30 has a first visible surface 31 and a second visible surface 32. The first visible surface 31 forms the majority of the surface of the cover 30. The second visible surface 32 is formed on an early edge region of the cover 30, which adjoins a top wall 4 (not shown in detail here) of the inner compartment 10. Arranged in the first visible surface 31 in the region of a center axis of the cover 30 are the central air outlets 40, which release the air at different points in the heightwise direction of the storage compartment 11. The central air outlets 40 are also arranged in the second visible surface 32, to release cold air into the storage compartment 11 in proximity to the top wall 4 (not shown in detail here) of the inner compartment 10 in the region of the center axis M. The non-central air outlet 41 is arranged in a lateral region or non-central region of the center axis M of the cover 30 and in the second visible surface 32 of the cover 30. The non-central air outlet 41 is provided to supply the storage compartment 11 with cold air away from the central or center axis M of the cover 30 as well. It is therefore possible to achieve a homogeneous temperature distribution both in the heightwise direction and in the widthwise direction of the storage compartment 11.

Figure 3:
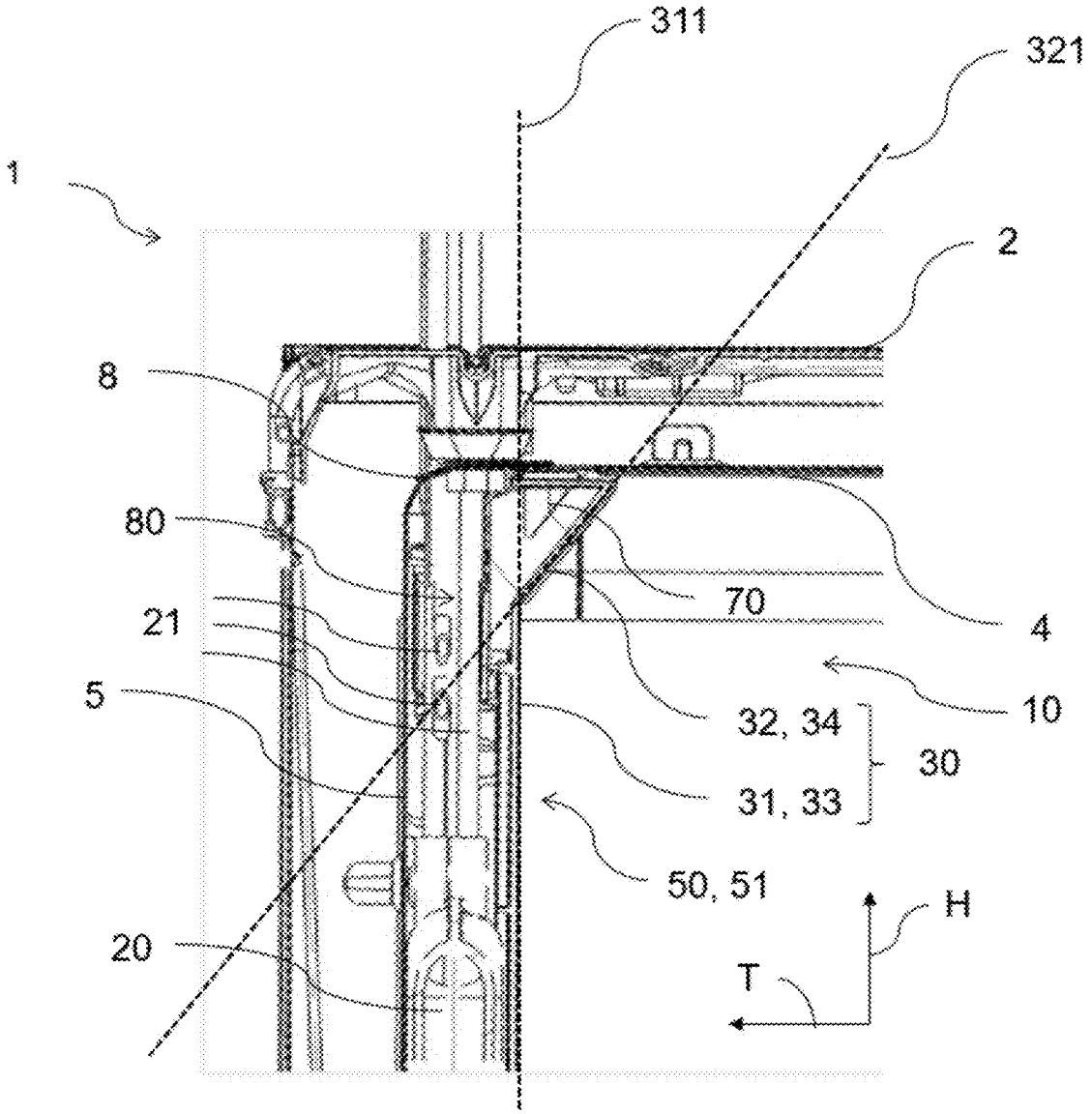
FIG. 3 is a vertical cross section through the inventive household refrigeration appliance according to FIG. 1.

FIG. 3 shows a vertical cross section through the inventive household appliance 1. Unlike FIGS. 1 and 2, FIG. 3 also shows an installation space 80 with a water tank 20 and water conduits 21, which are arranged between the rear wall 5 of the inner compartment 10 and the cover 30. The water tank 20 is part of a water supply system, which supplies a water dispenser (not shown in detail here) in the door of the household refrigeration appliance 1 with cold water filtered by the water filter 26 and supplies the icebox 25 with water for producing ice cubes.

FIG. 3 also shows the inner compartment 10, which is divided by the cover 30 into a cold air distribution region 50 and the storage compartment 11 or storage region for storing chilled goods. The cover 30 therefore forms a boundary between the storage compartment 11 available for storing chilled goods and a cold air distribution region 50 available for distributing the cold air. Arranged in the cold air distribution region 50 are a cold air distribution system 51 and functional parts, for example the water tank 20, the water conduits 21, electrical or refrigeration parts, of the household refrigeration appliance 1.

FIG. 3 also shows the first visible surface 31 or first cover segment 33 of the cover 30 and a second visible surface 32 or second cover segment 34 of the cover 30, which are formed at an angle or in an angled manner to one another. The first visible surface 31 is arranged at a distance from the rear wall 5. Arranged in an installation space 80 between the first visible surface 31 and the rear wall 5 are water-conducting parts, for example as shown here the water tank 20 and the water conduits 21. A horizontal cold air duct segment 70 extends essentially perpendicular to a vertical cold air duct segment 60 (not shown in detail here) extending essentially in the heightwise direction of the inner compartment 10. The horizontal cold air duct segment 70 extends to the level of the second visible surface 32 of the cover 30 and adjoins the top wall 4 of the inner compartment 10.

The longitudinal direction of the horizontal cold air duct segment 70 extends between a first visible surface plane 311 and a second visible surface plane 321. The horizontal cold air duct segment 70 is therefore located essentially completely in front of a plane formed by the first visible surface 31 of the cover 30 but behind a plane formed by the first visible surface 32, which is arranged at an angle to the first visible surface plane 311.

The horizontal cold air duct segment 70 also runs along a corner region 8, which is arranged between the top wall 4 of the inner compartment 10 and the rear wall 5 of the inner compartment 10. The corner regions of the storage compartment 11 or generally the inner compartment 10 are not particularly suitable for the storage of chilled goods, as they cannot be accessed easily by a customer from the access opening 7. Such regions or corner regions 8 of the inner compartment 10 can therefore be used particularly effectively for the arrangement of functional components, such as air-conducting, electrical or water-conducting parts, of the household refrigeration appliance 1, without losing any significant amount of usable storage space in the storage compartment 11.

Figure 4:
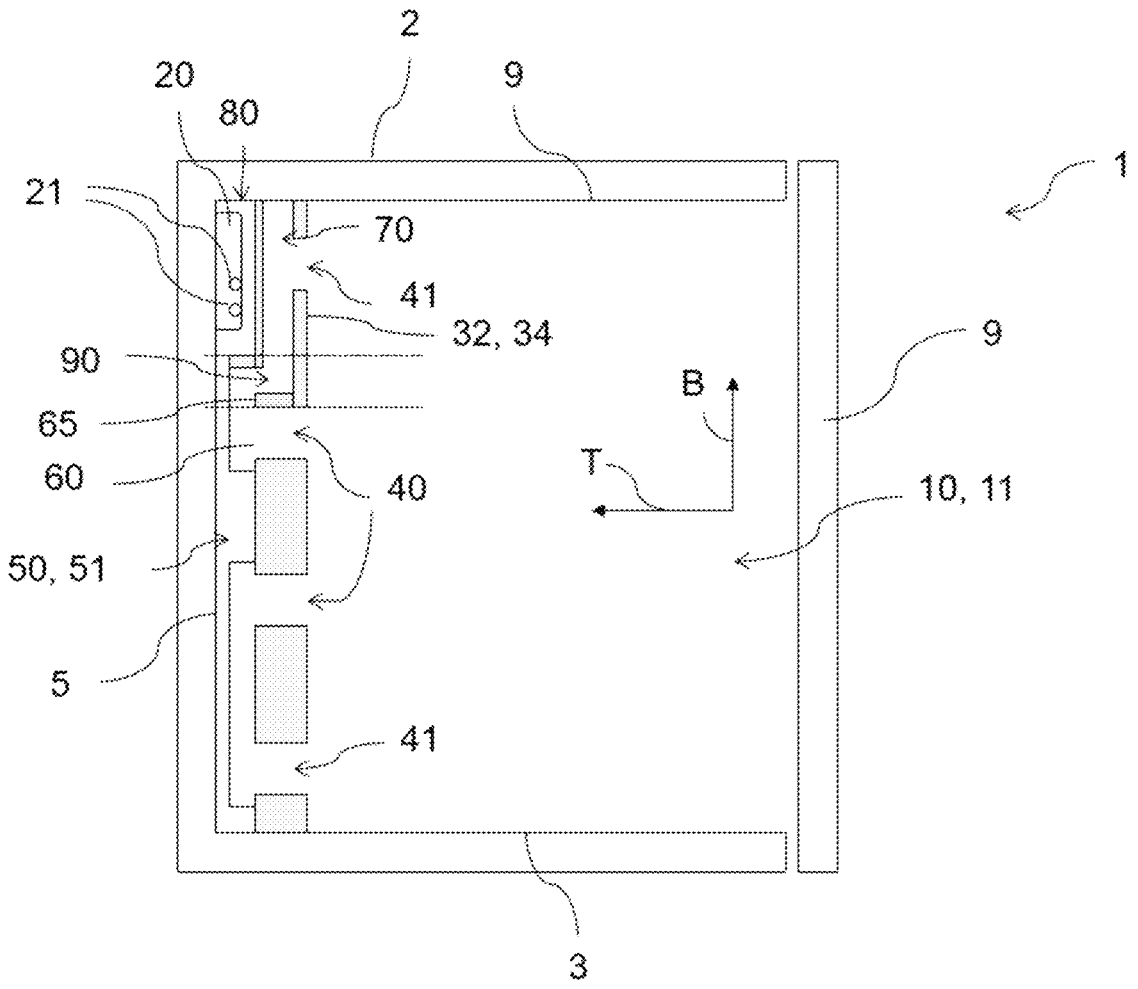
FIG. 4 is a horizontal schematic cross section through the inventive household refrigeration appliance.

FIG. 4 shows a horizontal schematic cross section through the inventive household refrigeration appliance 1. Unlike the preceding figures FIG. 4 shows the vertical cold air duct segment 60, which supplies the horizontal cold air duct segment 70 with cold air, which comes from an evaporator (not shown here) and is released by way of the non-central air outlet 41 into the storage compartment 11. The horizontal cold air duct segment 70 is arranged with an offset relative to the vertical cold air duct segment 60 in the depthwise direction T of the inner compartment 10. The horizontal cold air duct segment 70 is therefore further away from the rear wall 5 than the vertical cold air duct segment 60 or it projects further into the storage compartment 11 than the vertical cold air duct segment 60. So that the horizontal cold air duct segment cannot be seen from the storage compartment 11, the second visible surface 32 or the second cover segment 34 covers the horizontal cold air duct segment 70. Located between the horizontal cold air duct segment 70 and the vertical cold air duct segment 60 is a connecting segment 90, which connects the two cold air duct segments to one another for flow purposes. A partial air flow 48 branching from the main air flow 46 in the vertical cold air duct segment 60 intersects a first visible surface plane 311 (not shown here) and is deflected by the connecting segment 90 to run horizontally in the widthwise direction B or in the direction of the left 3 or right side wall 9 of the inner compartment 10. So that the main air flow flowing in the vertical cold air duct segment 60 is divided between the air outlets 40, 41, there is a divider 65 present in proximity to the connecting segment 90. The divider 65 is preferably formed from a projection formed in the heat insulation layer 62, which projects into the vertical cold air duct segment 60.

FIG. 4 shows the arrangement of the installation space 80, in which the water tank 20 and water conduits 21 are arranged, between the horizontal cold air duct segment 70 and the rear wall 5 in more detail. This allows water conduits 21 or the water tank 20 to cross as they run along the rear wall 5. As frost damage can result from thermal influences of the horizontal cold air duct segment 70 on the water conduits, there has to be a sufficient distance or a heat insulation layer 62 between the cold air duct segment 70 and the water-conducting components 20, 21 arranged in the installation space 80. As the horizontal cold air duct segment 70 is arranged with an offset relative to the vertical cold air duct segment 60 in the depthwise direction of the inner compartment 10 or is at a greater distance from the rear wall 5 of the inner compartment 10 than the vertical cold air duct segment 60, it is possible to locate the water-conducting parts 20, 21 and the cold air-conducting parts 60, 70 on the rear wall 5. It is even possible for these to cross on the rear wall 5 or in the cold air distribution region 50 without the risk of frost damage. This means that an even temperature distribution can be achieved in the storage compartment 11 and water-conducting parts 20, 21 can be arranged in a cold air distribution region 50 covered by the cover 30.

Figure 5:
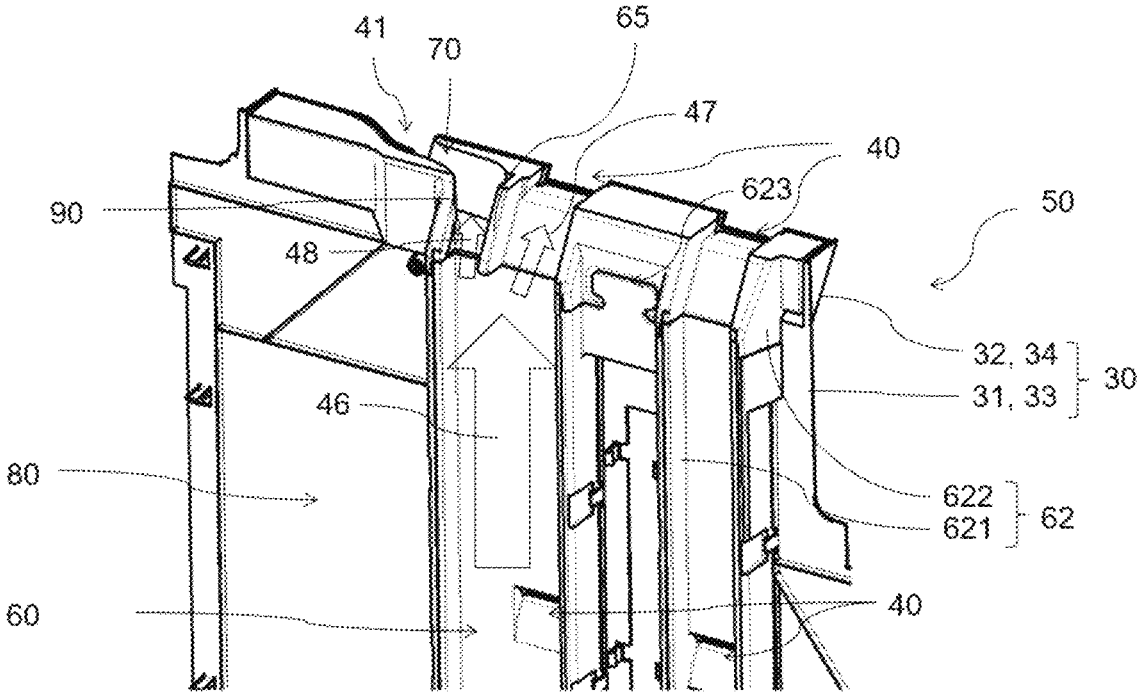
FIG. 5 is a perspective rear view of a first embodiment of the cover of the inventive household refrigeration appliance.

FIG. 5 shows a rear view of a first embodiment of the cover 30 of the inventive household refrigeration appliance 1. Unlike the preceding FIGS. 1-4 this embodiment shows a main air flow 46 flowing in the vertical cold air duct segment 60, which is divided by the divider 65 into a first partial air flow 47 and a second partial air flow 48. The first partial air flow 47 is released into the storage compartment 11 through the central air outlet 40. To this end the first partial air flow 47 is switched from a vertical alignment to a horizontal alignment and released into the storage compartment 11 in the direction of the access opening 7. The second partial air flow 48 is deflected by the connecting segment 90 with an alignment that is initially in a horizontal direction toward the access opening 7 and, once the second partial air flow 48 has intersected a plane 311 defined by the first visible surface 31, the connecting segment 90 deflects the second partial air flow 48 into the horizontal cold air duct segment 70 in the direction of the right side wall 9 (not shown here) of the inner compartment. It is of course also possible for the second partial air flow 48 to be deflected in the direction of the left side wall 3 (not shown here) by the connecting segment 90. It is also possible for partial air flows 48 to be deflected by the connecting segment 90 respectively in the direction of the left side wall 3 and the right side wall 9 of the inner compartment 10. The partial air flow 48 in the horizontal cold air duct segment 70 can be blown out into the storage compartment 11 through the non-central air outlet 41. A plurality of air outlets 40 and the non-central air outlet 41 are configured as openings in the region of the second visible surface 32, with the non-central air outlet 41 arranged in an edge region of the cover 30 in proximity to one of the side walls 3 and the air outlets 40 arranged in a more central or middle region of the cover 30.

FIG. 5 also shows the heat insulation layer 62, which is arranged between the cover 30 and the rear wall 5 (not shown here) of the inner compartment 10. The heat insulation layer 62 forms the cold air distribution system 51, which is formed from the vertical cold air duct segment 60 and the cold air duct segment 70 running horizontally parallel to the rear wall 5 (not shown here). The heat insulation layer 62 has a first heat insulation segment 621 and a second heat insulation segment 622. The vertical cold air duct segment 60 is configured in the first heat insulation segment 621 and the cold air duct segment 70 running horizontally parallel to a rear wall 5 (not shown in detail here) is configured in the second heat insulation segment 622. The first heat insulation segment 621 and the second heat insulation segment 622 are connected to one another with a form fit. The form-fit connection can be achieved with simple and economical means, for example using a plug-type connection, latching connection or generally by contours that can be connected to one another with a form fit on the edge regions of the first heat insulation segment 621 and the second heat insulation segment 622.

The cover 30 is formed by the first visible surface 31, which is arranged essentially parallel to the rear wall 5 (not shown here) of the inner compartment 10, and by the second visible surface 32, which is arranged at an angle to the first visible surface 31 or the rear wall 5 (not shown here). The angle of the second visible surface 32 gives the cover 30 covering the rear wall 5 an esthetically pleasing appearance. Characteristic gaps or edges, which encourage the accumulation of dirt, are therefore not formed in the cover 30 or, if they are, they are out of the direct view of a user looking at the storage compartment 11 from the access opening 7. The angled second visible surface 32 means that the horizontal cold air duct segment 70 also takes up less storage space in the storage compartment 11. The angled configuration of the second visible surface 32 relative to the first visible surface 31 also means the partial air flow 47 has to be deflected less, thereby minimizing the flow resistance in the cold air distribution system 51.

In FIG. 5 the connecting segment 90 is also arranged between the vertical cold air duct segment 60 and the horizontal cold air duct segment 70. The connecting segment 90 deflects the partial air flow 48 branching from the main air flow from the vertical cold air duct segment 60 into the horizontal cold air duct segment 70. A correspondingly arched contour of the connecting segment 90 allows flow resistance to be minimized. The connecting segment 90 conducts the partial air flow 48 branching from the main air flow 46 from a region behind the visible surface 31 or between the rear wall 5 (not shown here) and the first visible surface 31 into a region in front of the first visible surface 31 or between the storage compartment 11 and the first visible surface 31. The horizontal cold air duct segment 70 is therefore arranged in front of the first visible surface 31 or between the first visible surface 31 and the storage compartment 11 and the vertical cold air duct segment 60 is arranged between the rear wall 5 (not shown here) of the inner compartment 10 and the first visible surface 31 or behind the first visible surface 31.

Figure 6:
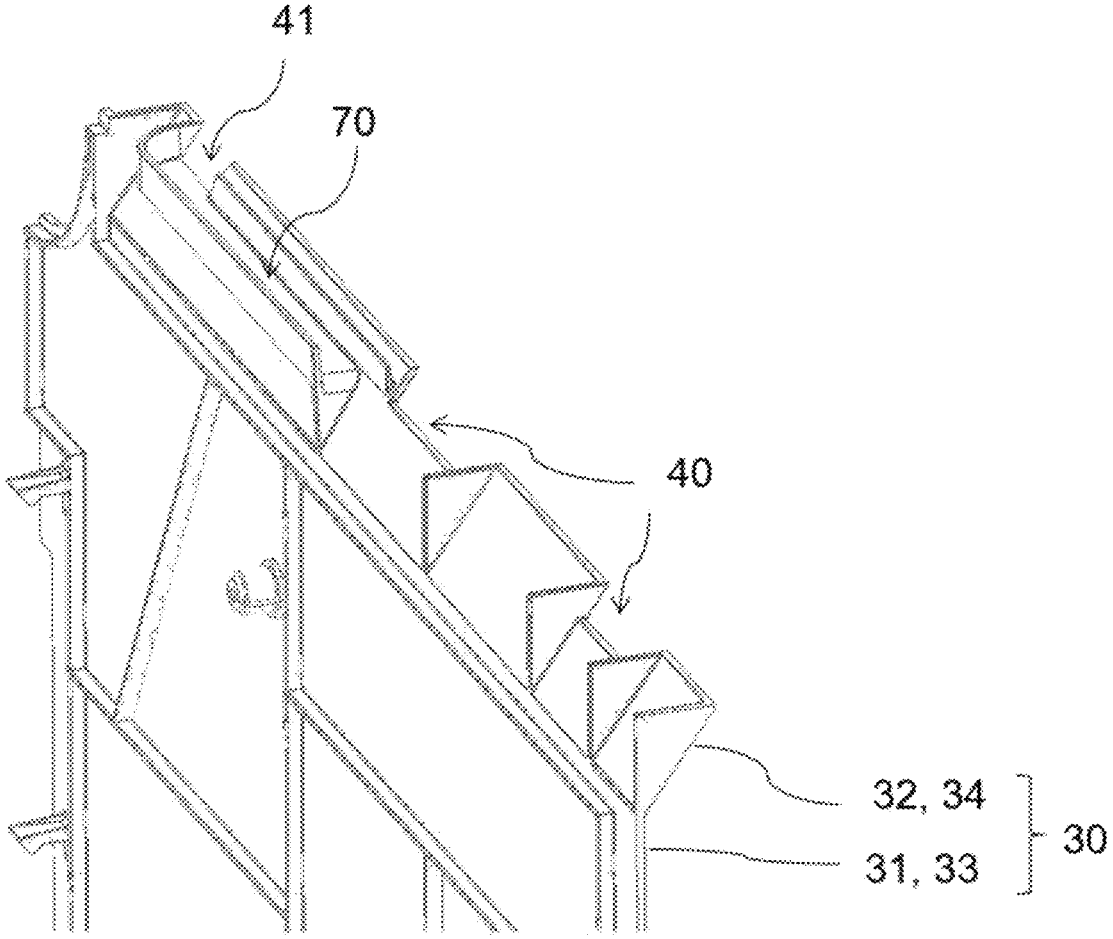
FIG. 6 is a rear view of a second embodiment of the cover of the inventive household refrigeration appliance.

FIG. 6 shows a rear view of a second embodiment of the cover of the inventive household refrigeration appliance 1. In this embodiment the horizontal cold air duct segment 70 is configured as an integral part of the cover 30. The horizontal cold air duct segment 70 is therefore formed by walls molded to the cover 30, which define a horizontal cold air duct segment 70. All this requires is a first wall protruding in a perpendicular manner from the cover 30 or the first visible surface 31 of the cover 30 with a second wall perpendicular to the first wall adjoining it. The first wall and second wall molded to the cover 30 enclose a space, through which a partial air flow 48 branching from a main air flow 46 can flow to the non-central air outlet 41 arranged away from the central region of the cover 30.

The following is a summary list of reference numerals and the corresponding structure used in the above description of the invention:

1 Household refrigeration appliance
2 Housing
3 Left side wall
4 Top wall
5 Rear wall
6 Bottom wall
7 Access opening
8 Corner region
9 Right side wall
10 Inner compartment
11 Storage compartment
15 Shelves
16 Drawers
20 Water tank
21 Water conduits
25 Icebox
26 Water tank
30 Cover
31 First visible surface
311 First visible surface plane
32 Second visible surface
321 Second visible surface plane
33 First cover segment
34 Second cover segment
40 Central air outlet
41 Non-central air outlet
46 Main air flow
47 First partial air flow
48 Second partial air flow
50 Cold air distribution region
51 Cold air distribution system
60 Vertical cold air duct segment
62 Heat insulation layer
621 First heat insulation segment
622 Second heat insulation segment
623 Plug-type connection
65 Divider
70 Horizontal cold air duct segment
80 Installation space
90 Connecting segment
M Center axis
T Depthwise direction
B Widthwise direction
H Heightwise direction

The invention claimed is:

1. A household refrigeration appliance, comprising:

a housing;

an inner compartment disposed in said housing and having a rear wall, a top wall, a left-side wall, a right-side wall and an access opening;

a cold air distribution system;

a cover extending along said rear wall of said inner compartment and dividing said inner compartment into a storage compartment for chilled goods and a cold air distribution region with said cold air distribution system disposed therein, said cover having a first visible surface facing said access opening of said inner compartment, said cover having a non-central air outlet formed therein disposed in a corner of said rear wall and said top wall at said left-side wall or at said right-side wall; and said cold air distribution system containing a vertical cold air duct segment extending in a direction of said top wall, and is disposed generally parallel to said rear wall in a longitudinal direction, and at least one horizontal cold air duct segment branching from said vertical cold air duct segment and extending in a direction of said left-side wall or said right-side wall to said non-central air outlet, and is disposed generally parallel to said rear wall, said horizontal cold air duct segment and said vertical cold air duct segment are disposed with an offset in a depthwise direction of said inner compartment, at least part of a longitudinal extension of said vertical cold air duct segment being disposed behind said first visible surface and at least part of a longitudinal extension of said horizontal cold air duct segment being disposed in front of said first visible surface.

2. The household refrigeration appliance according to claim 1, wherein:

at least a majority of the longitudinal extension of said horizontal cold air duct segment adjoins said top wall and opens into said non-central air outlet to said storage compartment.

3. The household refrigeration appliance according to claim 1, wherein said cover covers said rear wall completely.

4. The household refrigeration appliance according to claim 1, wherein a main air flow in said vertical cold air duct segment can flow generally perpendicular to said top wall of said inner compartment and a partial air flow from said vertical cold air duct segment in said horizontal cold air duct segment can flow generally parallel to said top wall of said inner compartment.

5. The household refrigeration appliance according to claim 4, further comprising a connecting segment disposed between said vertical cold air duct segment and said horizontal cold air duct segment, intersecting a first visible surface plane formed by said first visible surface and connecting said vertical cold air duct segment and said horizontal cold air duct segment.

6. The household refrigeration appliance according to claim 5, wherein said cover having a second visible surface formed by a second cover segment and said first visible surface is formed by a first cover segment of said cover, said second cover segment being disposed closer to said access opening than said first cover segment.

7. The household refrigeration appliance according to claim 6, wherein said second visible surface is disposed at an angle to said first cover segment.

8. The household refrigeration appliance according to claim 6, wherein a majority of said horizontal cold air duct segment is disposed behind said second cover segment and in front of said first cover segment.

9. The household refrigeration appliance according to claim 6, wherein said first cover segment and said second cover segment are configured as a single piece.

10. The household refrigeration appliance according to claim 6, wherein the longitudinal extension of said horizontal cold air duct segment is disposed between said first visible surface plane and a second visible surface plane formed by said second visible surface.

11. The household refrigeration appliance according to claim 6, wherein said second cover segment directly adjoins said top wall of said inner compartment.

12. The household refrigeration appliance according to claim 6, wherein said cover has a central air outlet formed therein, said partial air flow includes a first partial air flow branching from said main air flow to flow out through said central air outlet into said storage compartment and a second partial air flow branching from the main air flow to flow out by way of said horizontal cold air duct segment through said non-central air outlet into said storage compartment.

13. The household refrigeration appliance according to claim 12, wherein said central air outlet and said non-central air outlet are disposed in said second visible surface.

14. The household refrigeration appliance according to claim 12, wherein said cold air distribution system having a divider disposed in a region of said connecting segment, said divider dividing a volume of the main air flow in said vertical cold air duct segment between said central air outlet and said non-central air outlet.

15. The household refrigeration appliance according to claim 6, wherein said horizontal cold air duct segment is disposed completely behind said second cover segment and in front of said first cover segment.

16. The household refrigeration appliance according to claim 6, wherein said second visible surface is disposed at an angle to said first cover segment that slopes away from said access opening in a downward direction.

17. The household refrigeration appliance according to claim 1, further comprising a first heat insulation segment disposed between said cover and said vertical cold air duct segment and a second heat insulation segment disposed between said cover and said horizontal cold air duct segment, said first heat insulation segment and said second heat insulation segment being connected to one another with a form fit connection.

* * * * *